US006623416B2

(12) United States Patent
Lemke et al.

(10) Patent No.: US 6,623,416 B2
(45) Date of Patent: Sep. 23, 2003

(54) SINGLE FACER WITH RESILIENT SMALL DIAMETER CORRUGATING ROLL

(75) Inventors: Dennis L. Lemke, Phillips, WI (US); Robert W. Klimowski, Phillips, WI (US); Eric J. Obermeyer, Phillips, WI (US); Carl R. Marschke, Phillips, WI (US)

(73) Assignee: Marquip, LLC, Phillips, WI (US)

( * ) Notice: Subject to any disclaimer, the term of this patent is extended or adjusted under 35 U.S.C. 154(b) by 0 days.

(21) Appl. No.: 10/052,085

(22) Filed: Jan. 18, 2002

(65) Prior Publication Data

US 2002/0091056 A1 Jul. 11, 2002

Related U.S. Application Data

(63) Continuation-in-part of application No. 09/756,888, filed on Jan. 9, 2001, which is a continuation-in-part of application No. 09/336,104, filed on Jun. 18, 1999, now Pat. No. 6,170,549.

(51) Int. Cl.[7] ..... B31F 1/20
(52) U.S. Cl. ..... 493/463; 156/462; 156/472
(58) Field of Search ..... 493/463, 365–371

(56) References Cited

U.S. PATENT DOCUMENTS

| | | | |
|---|---|---|---|
| 2,589,966 | A | 3/1952 | Rullo |
| 3,688,735 | A | 9/1972 | Brenner |
| 3,931,791 | A | 1/1976 | Preuss et al. |
| 4,044,580 | A | 8/1977 | Worden et al. |
| 4,059,474 | A | 11/1977 | Coburn |
| 4,267,008 | A | 5/1981 | Owens |
| 4,319,947 | A | 3/1982 | Tokuno |
| 4,569,714 | A | 2/1986 | Tokuno |
| 4,631,109 | A | 12/1986 | Hirakawa |
| 4,738,744 | A | 4/1988 | Saller |
| 5,122,220 | A | 6/1992 | Seki |
| 5,275,656 | A | 1/1994 | Jendroska |
| 5,348,612 | A | 9/1994 | Buetikofer et al. |
| 5,628,865 | A | 5/1997 | Marschke |
| 5,951,816 | A | 9/1999 | Marschke |
| 6,012,501 | A | 1/2000 | Marschke |
| 6,170,549 | B1 | 1/2001 | Marschke |

FOREIGN PATENT DOCUMENTS

| | | |
|---|---|---|
| EP | 0 092 079 | 3/1983 |
| EP | 0 362 423 | 10/1988 |
| EP | 0 380 083 | 1/1990 |
| GB | 2 095 430 | 1/1982 |

*Primary Examiner*—Eugene Kim
*Assistant Examiner*—Tara Ho
(74) *Attorney, Agent, or Firm*—Andrus, Sceales, Starke & Sawall

(57) ABSTRACT

A single facer for corrugated paperboard of the type using a very large diameter fluted bonding roll and a much smaller diameter fluted corrugating roll which engages the bonding roll to provide a corrugating nip. The small diameter corrugating roll is made to be resilient by utilizing a thin walled roll shell so that it is capable of inward deflection in the corrugating nip in order to cushion impact and absorb the deflection as the rolls interengage along the nip. This cushioning deflection absorbs vibrational movement due to chordal action of the interengaging flutes, and thereby reduces noise level and roll wear and improves the quality and consistency of corrugation. A modified flute profile, compensating for flute pitch variations between the large diameter bonding roll and small diameter corrugating roll, assures uniform flute-to-flute engagement in the corrugating nip. Strategic positioning of the supporting stub shafts for the thin walled small corrugating roll axially outside the flute patterns provides substantially uniform small roll deflection along the nip.

11 Claims, 11 Drawing Sheets

SINGLE FACER WITH RESILIENT SMALL DIAMETER CORRUGATING ROLL

CROSS REFERENCE TO RELATED APPLICATIONS

This is a continuation-in-part of U.S. Ser. No. 09/756,888, filed Jan. 9, 2001, which is a continuation-in-part of U.S. Ser. No. 09/336,104, filed Jun. 18, 1999, now U.S. Pat. No. 6,170,549.

FIELD OF THE INVENTION

The invention pertains to an apparatus for forming a single face web of corrugated paperboard. More particularly, the invention relates to a corrugating roll assembly comprising a large diameter corrugating roll (i.e. a bonding roll) and a small diameter corrugating roll in which the small diameter roll is resilient so that it is capable of deflection in the vicinity of the corrugating nip in order to cushion impact as the rolls mesh along the corrugating nip.

BACKGROUND OF THE INVENTION

In the manufacture of corrugated paperboard, a single facer apparatus is used to corrugate the medium web, to apply glue to the flute tips on one face of the corrugated medium web, and to bring a liner web into contact with the glued flute tips of the medium web with the application of sufficient heat and pressure to provide an initial bond. For many years, conventional single facers have typically included a pair of fluted corrugating rolls and a pressure roll, which are aligned so that the axes of all three rolls are generally coplanar. The medium web is fed into a corrugating nip formed by the interengaging corrugating rolls. While the corrugated medium web is still on one of the corrugating rolls, adhesive is applied to the flute tips by a glue roll. The liner web is immediately thereafter brought into contact with the adhesive-coated flute tips and the composite web then passes through the nip formed by the corrugating roll and the pressure roll.

In the past, the fluted corrugating rolls have typically been generally the same size as each other. More recently, a significantly improved single facer apparatus has been developed in which the corrugating rolls comprise a large diameter bonding roll and a substantially smaller diameter roll, with the ratio of diameters about being 2.2:1 or greater. Such apparatus is disclosed in U.S. Pat. Nos. 5,628,865, 5,951,816, and 6,012,501 and application Ser. No. 09/244,904, filed Feb. 4, 1999, now abandoned, all of which disclosures are incorporated herein by reference. In accordance with these disclosures, the single facer typically includes a backing arrangement for the small diameter corrugating roll to prevent axial bending of the roll and to assure a uniform nip pressure along the full length of the interengaging flutes. One preferred backing arrangement includes a series of axially adjacent pairs of backing idler rollers, each pair having a backing pressure belt entrained therearound. Each of the pressure belts is positioned to bear directly against the fluted surface of the small diameter corrugating roll on the side of the small corrugating roll opposite the corrugating nip. Each pair of associated idler rolls and pressure belts is mounted on a linear actuator, and can thus engage the small diameter corrugating roll with a selectively adjustable force. The application of force against the small diameter corrugating roll, in turn, applies a uniform force along the corrugating nip between the small diameter roll and the large diameter roll and along the full length of the nip. Typically, a force of approximately 130 lbs. per linear inch is desirable for properly fluting a medium web at typical line speeds.

The impact of the flutes on the small diameter corrugating roll against the flutes on the large diameter corrugating roll along the corrugating nip can cause undesirable vibrations that can be detrimental to the quality of corrugation. More specifically, chordal action due to the interengagement of the roll flutes causes the small diameter roll to move up and down. The center axis of the large diameter roll is analytically stationary, and vibrational energy is transmitted primarily to the small diameter roll and to the belted backing arrangement. It has been found that excessive vibrations of the belted backing arrangements is sometimes evident under certain high-speed operating conditions, especially when the system is operated at or near the natural resonant frequency of the system. Vibration also results in increased noise and rapid wear. In severe cases, high vibration led to loss of flute caliper, cutting of the medium web and flute fracture.

In U.S. Pat. No. 6,170,549, the disclosure of which is also incorporated by reference herein, the small diameter corrugating roll is made to be resilient, e.g., constructed using an inner steel tube or carbon fiber tube having approximately a four inch outside diameter and a ⅛ inch wall thickness. In the preferred embodiment, the roll is a composite roll in which the flutes are made of a sacrificial material such as reinforced phenolic resin as described in the above-identified abandoned application Ser. No. 09/244,904. The flutes are preferably cut in a resin sleeve mounted on the outside surface of the resilient steel or carbon fiber tube with epoxy. The resilient tube deflects inward as the flutes on the small diameter roll impact the flutes on the large diameter roll at the corrugating nip. Flutes made of a sacrificial phenolic resin or other similar material assist in cushioning the impact, although deflection of the resilient tube accounts for a substantial portion of the cushioning. The flutes on the small diameter corrugating roll have a different profile than the flutes on the large diameter corrugating roll such that there is a clearance between flute tips on the large diameter bonding roll and the gullets or roots of the flutes on the small diameter corrugating roll. This arrangement was intended to assure that the small diameter corrugating roll follows the bonding roll more consistently.

Extensive testing of small diameter corrugating rolls made in accordance with the teaching of U.S. Pat. No. 6,170,549 revealed that a sacrificial fluted layer exhibits unsatisfactory wear characteristics and a short wear life under certain conditions of use. Furthermore, the use of different flute profiles on the large and small diameter corrugating rolls tend to increase the amplitude of small roll deflection.

To address the foregoing problems, the fluted resin outer layer was eliminated, a somewhat larger diameter steel roll shell was adopted and the flutes were cut in the steel shell in a conventional manner. The all steel roll used in this modification is described in co-pending U.S. application Ser. No. 09/756,888, filed Jan. 9, 2001, the disclosure of which is also incorporated by reference herein. Although some improvement in wear life of the small corrugating roll was realized, there was somewhat increased wear on the flutes of the large diameter corrugating roll and, in addition, excessive amplitude of small roll deflection and consequent vibration and noise remained problems.

SUMMARY OF THE INVENTION

In accordance with the present invention, it has been discovered that with proper support of the thin walled flexible small corrugating roll, both along its length and at its opposite journaled ends, by eliminating the difference in flute profile depths between the large and small diameter corrugating rolls, and by better matching the flute profiles, the problems of excessive wear, vibration and noise can be significantly reduced. In addition, it has been found possible to utilize even thinner walled steel roll shells. This is believed to be due primarily to a reduction in the amplitude of the deflection, thereby reducing the possibility of fatigue cracking in the wall of the roll.

Thus, in a single facer having a large diameter fluted bonding roll with a flute pattern of a given axial length and an interengaging small diameter fluted corrugating roll having a flute pattern corresponding to the flute pattern of the bonding roll and supported for rotatable interengagement with the bonding roll by a series of axially spaced back-up belts to form a corrugating nip, the improvement of the present invention comprises a small diameter corrugating roll formed from a cylindrical steel shell having a minimum wall thickness after formation of the flutes, as measured from the flute gullets to the shell ID, as little as about ⅛ inch. In one preferred embodiment, the steel roll shell has an initial OD of about 5.25 inches and a wall thickness of about 0.35 inch. After flute formation, the preferred minimum wall thickness is about 0.15 inch. Preferably, the small diameter corrugating roll includes a pair of cylindrical hubs that are positioned within the opposite ends of the roll shell to support the roll for rotation; and the roll shell has an axial length sufficient to position the axial inner ends of the hubs outside the bonding roll flute pattern. Each of the back-up belts is supported on a pair of rollers and includes an actuator for applying a selected support load to the small diameter corrugating roll. In general, for a nominal 5 inch diameter roll, the minimum wall thickness after flute formation is preferably in the range of about 0.15 inch to 0.23 inch.

DETAILED DESCRIPTION OF THE PREFERRED EMBODIMENT

Figure 1:
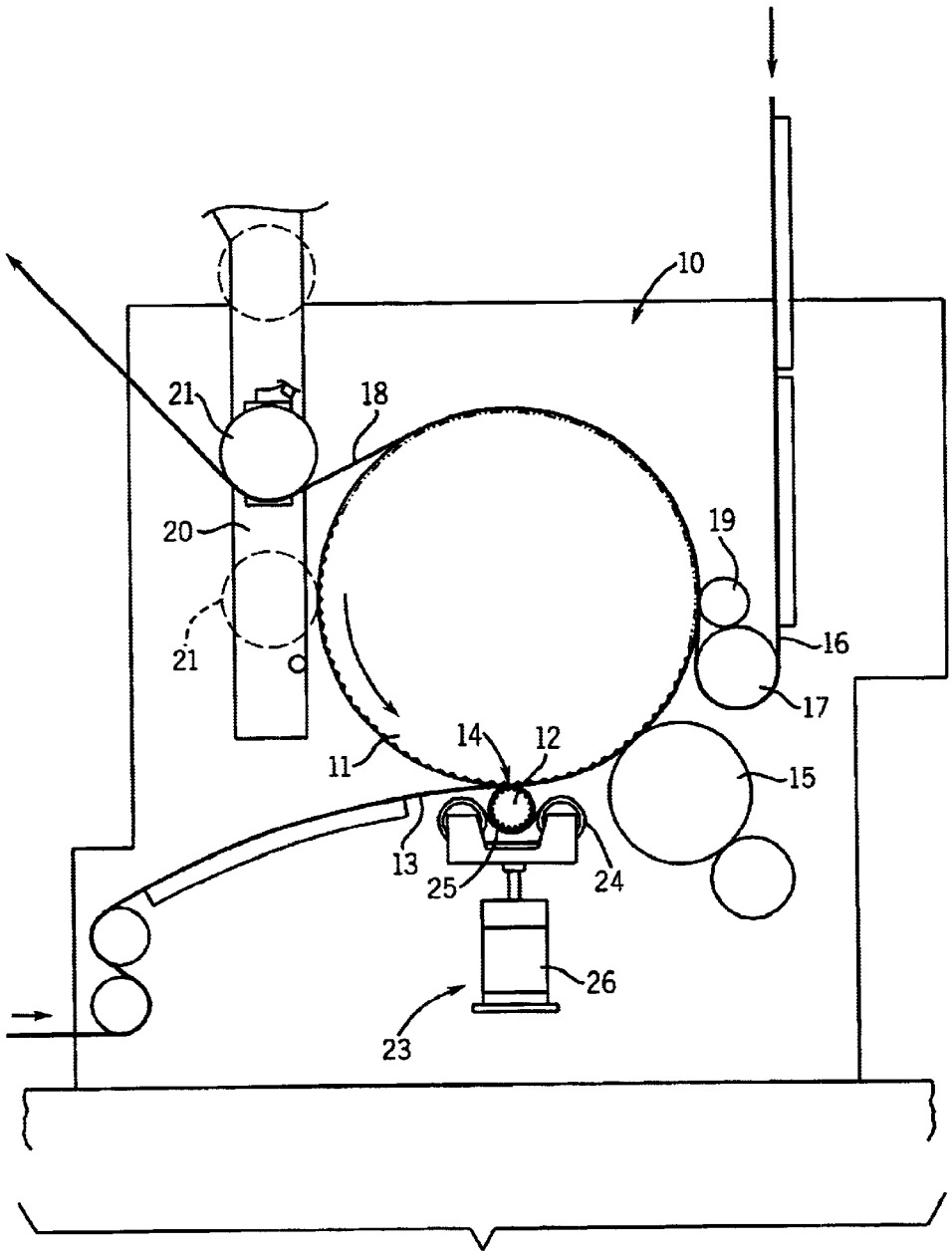
FIG. 1 is a side elevation view of a single facer using a small diameter corrugating roll constructed and mounted in accordance with the present invention.

Referring initially to FIG. 1, a single facer 10 includes a large diameter upper corrugating roll 11 (sometimes hereinafter referred to as bonding roll 11) and a much smaller diameter lower corrugating roll 12. Both rolls 11 and 12 are made of steel and are fluted and mounted for interengaging rotational movement on parallel axes, all in a manner well known in the art, as described in detail in the above identified patents and patent applications. A medium web 13, which is typically pretreated by moistening and heating, is fed into a corrugating nip 14 formed by the interengaging corrugating rolls 11 and 12. As the corrugated medium web 13 leaves the nip 14, it remains on the surface of the large diameter bonding roll 11. Immediately downstream from the nip 14, a glue roll 15 applies a liquid adhesive, typically starch, to the exposed flute tips of the corrugated medium web 13. Immediately thereafter, a liner web 16 is brought into contact with the glued flute tips of the corrugated medium web by a liner delivery roll 17, sometimes referred to as a generator roll. The resulting freshly glued single face web 18 continues around a portion of the outer circumference of the large diameter bonding roll 11. The initial bond between the medium web 13 and liner web 16 may be assisted with a soft contact roll 19 located immediately downstream from the delivery roll 17. The soft contact roll 19 presses the composite single face web 18 against the bonding roll 11 with a light and uniform force distributed across the full width of the web. Because the large diameter roll 11 also functions as a bonding roll, it is internally heated, for example with steam, to cause the starch adhesive to initially gelatinize and then enter the so-called "green bond" stage. By assuring that green bond is reached while the single face web 18 is still on the bonding roll 11, integrity of the glue lines is better assured and downstream handling, including back wrapping around a wrap roll 21, is not likely to disturb the bond. The extent of the wrap of the single face web 18 on the bonding roll and thus the circumferential residence time of the single face on the bonding roll may be varied by adjustably positioning the wrap roll along a positioning mechanism 20. The vertical position of the wrap roll 21 with respect to the surface of the bonding roll 11 may be selectively adjusted depending on a number of variables, such as paper weight, web speed, bonding roll temperature, starch composition, and the like.

Figure 2:
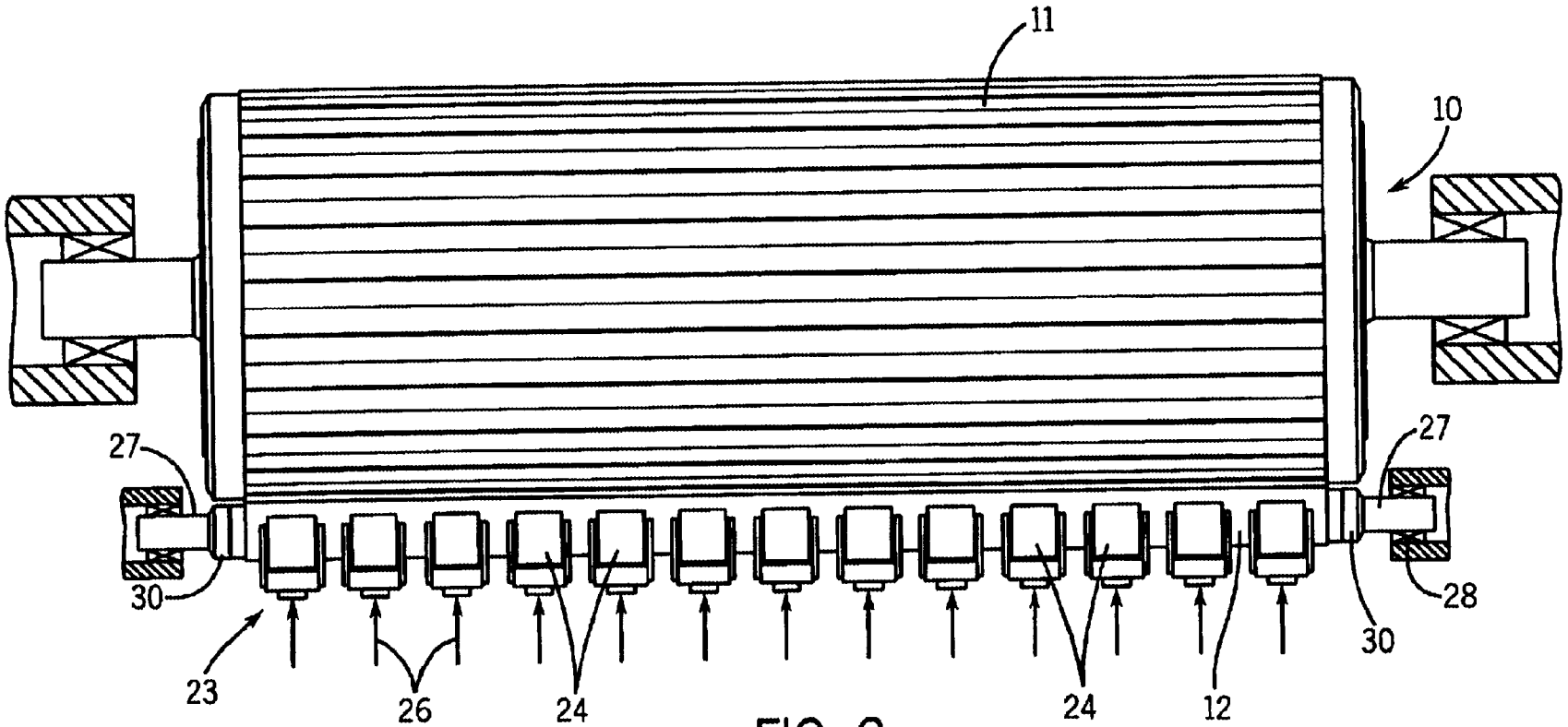
FIG. 2 is a front elevation view of a portion of the single facer shown in FIG. 1.

In the single facer shown in FIG. 1, the large diameter corrugating and bonding roll 11 typically has a diameter of about 39 inches (about 1,000 mm) and the smaller diameter lower corrugating roll 12 typically has a diameter of about 5 inches (about 130 mm), although the practical range of the ratio of the diameter of the large to small corrugating rolls 11 and 12 may vary considerably down to about 2.2:1. The prior art identified above and incorporated herein provides various backing arrangements for the small diameter roll 12, one of which backing arrangements 23 is shown in the drawing. Referring also to FIG. 2, the backing arrangement 23 includes a series of axially adjacent pairs of backing rolls 24, each of which pairs has a pressure or back-up belt 25 entrained therearound. Each of the back-up belts 25 is positioned to bear directly against the fluted outer surface of the small diameter corrugating roll 12. Each pair of idler rolls 24 and its respective back-up belt 25 is mounted on a linear actuator 26. By individually controlled operation of each linear actuator 26, the back-up belts may be made to engage the small diameter corrugating roll 12 with a selectively adjustable force. As indicated above, a back-up belt loading of about 130 lbs. per lineal inch is utilized. However, this backing force is typically applied only across the width of the medium web 13 being run. Laterally outside the width of the web, the back-up belts are loaded to provide a significantly lower force, for example, about 35 lbs. per lineal inch. The backing arrangement 23 is described in more detail in above identified U.S. Pat. No. 6,012,501.

The large diameter bonding roll 11 has substantially more mass than the small diameter corrugating roll 12 and, therefore, remains relatively stable as it rotates at high speeds. On the other hand, due to chordal action at the nip 14, radial up and down movement can occur in the small diameter corrugating roll 12 supported by the backing arrangement 23. Under extreme conditions, such vibrations can cause the small diameter corrugating roll 12 to bounce at the corrugating nip and, in any case, cause increased noise levels and increased wear rates. The vibration problem is exacerbated if the line speed matches the natural frequency of the system. For example, in prior designs of systems having a small corrugating roll, the roll was typically made of solid steel. Due to the mass of the solid small diameter corrugating roll, the natural frequency of the system occurred at a line speed of approximately 300 ft/min (about 90 m/min), which is within the typical operating range of a single facer 10. The use of a thin-walled small diameter corrugating roll was intended to eliminate the vertical displacement of a solid small diameter roll as a result of the chordal action and instead deflect sufficiently to absorb that displacement. However, the evolution in thin-walled small roll technology has not as yet adequately solved the problems associated with chordal action vibrations.

In accordance with the disclosure in co-pending application Ser. No. 09/756,888, it was found that a small diameter thin-walled corrugating roll of unitary all steel construction had certain advantages over a small diameter roll of composite construction including an inner steel tube with an outer layer of a synthetic resin material, such as a fiber reinforced phenolic resin. The relatively thin walled all steel roll was initially made from tubular stock having a wall thickness of 0.5 inch (about 13 mm), with the OD of the tube having a diameter of about 5.25 inch (about 133 mm). After cutting the flutes in the tube stock, the minimum remaining wall thickness was about 0.25 inch (about 6.5 mm). This small diameter tubular roll exhibited the desired flexibility to some extent, but it was found that serious vibration problems still occurred at certain speeds and, in some cases, fatigue cracking and premature failure of the rolls occurred. As indicated in the above identified co-pending application, the small diameter corrugating roll was made with a deeper flute profile than the flute profile for the large diameter bonding roll 11. The result was that, as the flutes of the respective rolls pass through the corrugating nip 14, only the flute tips of the small diameter corrugating roll made contact with the roots or gullets of the flutes on the large diameter bonding roll. Conversely, there was no contact between the flute tips of the bonding roll with the gullets of the flutes in the small diameter corrugating roll. In a flexible thin walled roll, the absence of bonding roll flute tip contact with flute gullets in the small diameter roll at the nip resulted in an increase in the amplitude of the chordal action. In other words, the radial deflection of the small diameter thin walled corrugating roll was greater than it would have been if full flute tip-to-gullet contact occurred between both corrugating rolls in the nip. With the bonding roll 11 and small diameter roll 12 having diameters mentioned above and utilizing a commonly used C-flute pattern, the amplitude of deflection of the small diameter roll may be as great at 0.005 in. (0.13 mm). It is believed that such increased amplitude in the chordal action contributed to the continuing vibration problems experienced in the all steel thin walled roll.

It has been found that by providing full flute-to-flute contact between both rolls 11 and 12 as the teeth move through the corrugating nip 14, the amplitude of deflection of the thin walled small diameter corrugating roll 12 is substantially reduced. This reduced amplitude results in a considerable reduction in impact and vibration, as well as quieter operation. Flute-to-flute contact is intended to mean that the flute tips of both rolls 11 and 12 contact the roots or gullets of the opposite roll as the flutes pass through the nip. As opposed to the prior art thin walled tube strategy where the gullets in the small diameter corrugating roll were deepened to preclude full contact by the teeth of the large diameter upper bonding roll 11, full tooth-to-tooth contact in accordance with this invention doubles the frequency of flute contact. However, such increased frequency is well below the resonant frequency of the small diameter roll made in accordance with this invention.

It has also been found that the large difference in diameters between the bonding roll 11 and the small corrugating roll 12 requires an adjustment in the flute pitch dimensions in order to avoid running interference, excessive tooth wear, and degradation in the quality of the fluted medium web 13. In prior art single facers, where the diameters of the corrugating rolls are substantially equal, the flutes are typically formed with the same flute tip-to-flute tip pitch on both rolls. This results in satisfactory flute interengagement between the rolls. However, when utilizing the prior art practice for cutting the flutes in the large diameter bonding roll 11 and small diameter corrugating roll 12 so that the flute tip-to-flute tip pitch is equal, a noticeable running interference is encountered that is attributable to the large difference in circular curvature between the two rolls. For example, it was found that with equal flute tip-to-flute tip pitch on the two rolls, the bonding roll 11 having a diameter of about 39 in. and the small diameter corrugating roll 12 having a diameter of about 5 in., there was an interference between the interengaging teeth of as much as about 0.008 in. (0.2 mm) per tooth pitch which, when considered cumulatively in a 50 tooth small corrugating roll 12, results in a total error in roll circumference of 0.400 in. (about 10 mm). The interference not only caused rapid tooth wear, but also prevented full small roll tooth-to-large roll gullet contact which adversely affected the quality of the corrugated medium web 13. In addition, the interference is believed to have been the source of additional vibration.

Figure 9:
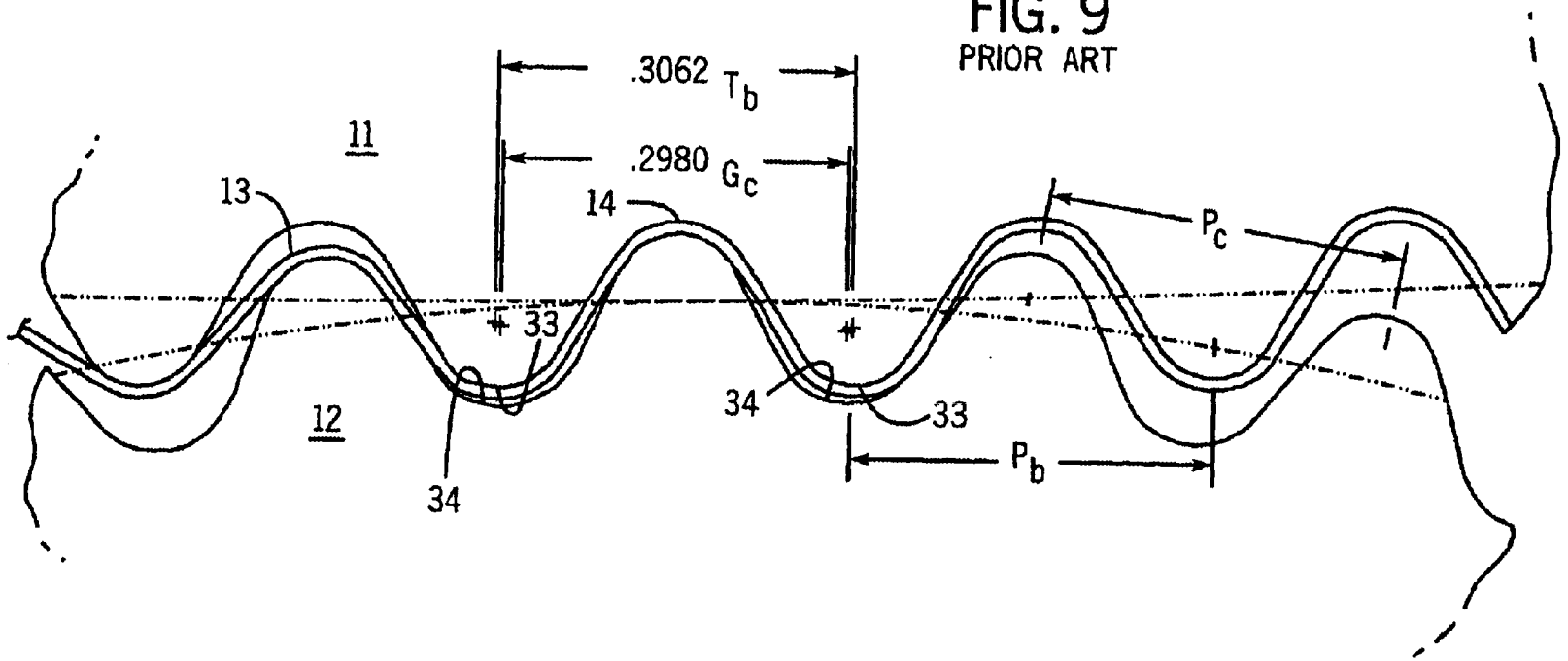
FIG. 9 PRIOR ART
FIGS. 9–11 are large schematic side views of the corrugating nip showing the adjustment in flute profiles to eliminate running interference.

FIG. 9 is a greatly enlarged schematic of the nip between the large diameter bonding roll 11 and the small diameter corrugating roll 12 and the medium web 13 being formed therein. In this view, the prior art flute pattern is shown wherein the flute tip pitch on both rolls is the same. Thus, the tip-to-tip pitch $P_b$ of the bonding roll 11 is equal to the tip-to-tip pitch $P_c$ of the small corrugating roll 12. To investigate the cause of the running interference between the flute tips at the nip 14, measurements were made of the chordal distance $T_b$ between the centers of adjacent circular bonding roll flute tips 33 and the chordal distance $G_c$ between the centers of the corresponding circular corrugating roll gullets 34. As shown, the latter distance was 0.0082 in. (about 0.2 mm) less than the corresponding distance for the bonding roll. As indicated above, this difference is cumulative and becomes a considerable amount (e.g. 0.400 in.) in the circumference of the small diameter corrugating roll 12.

Figure 10:
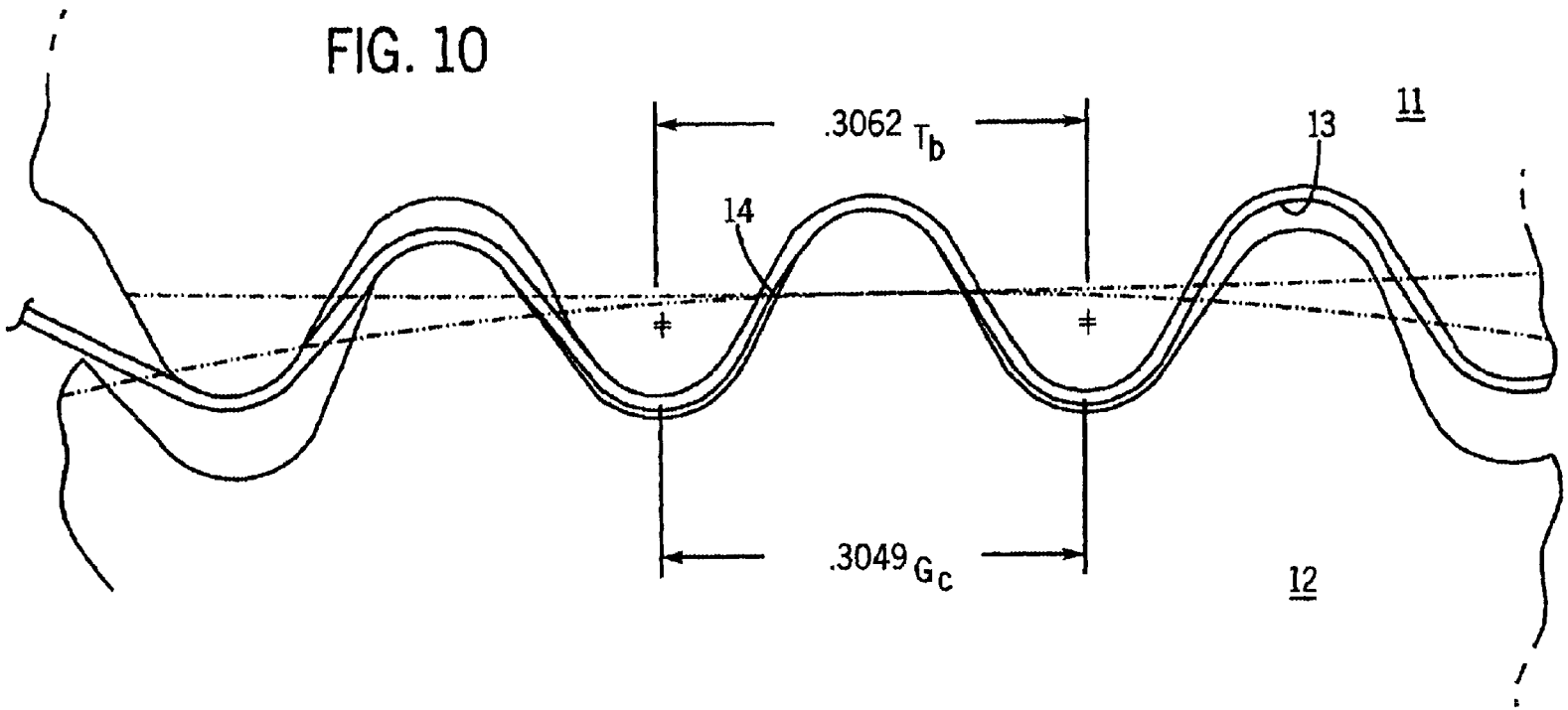
Figure 11:
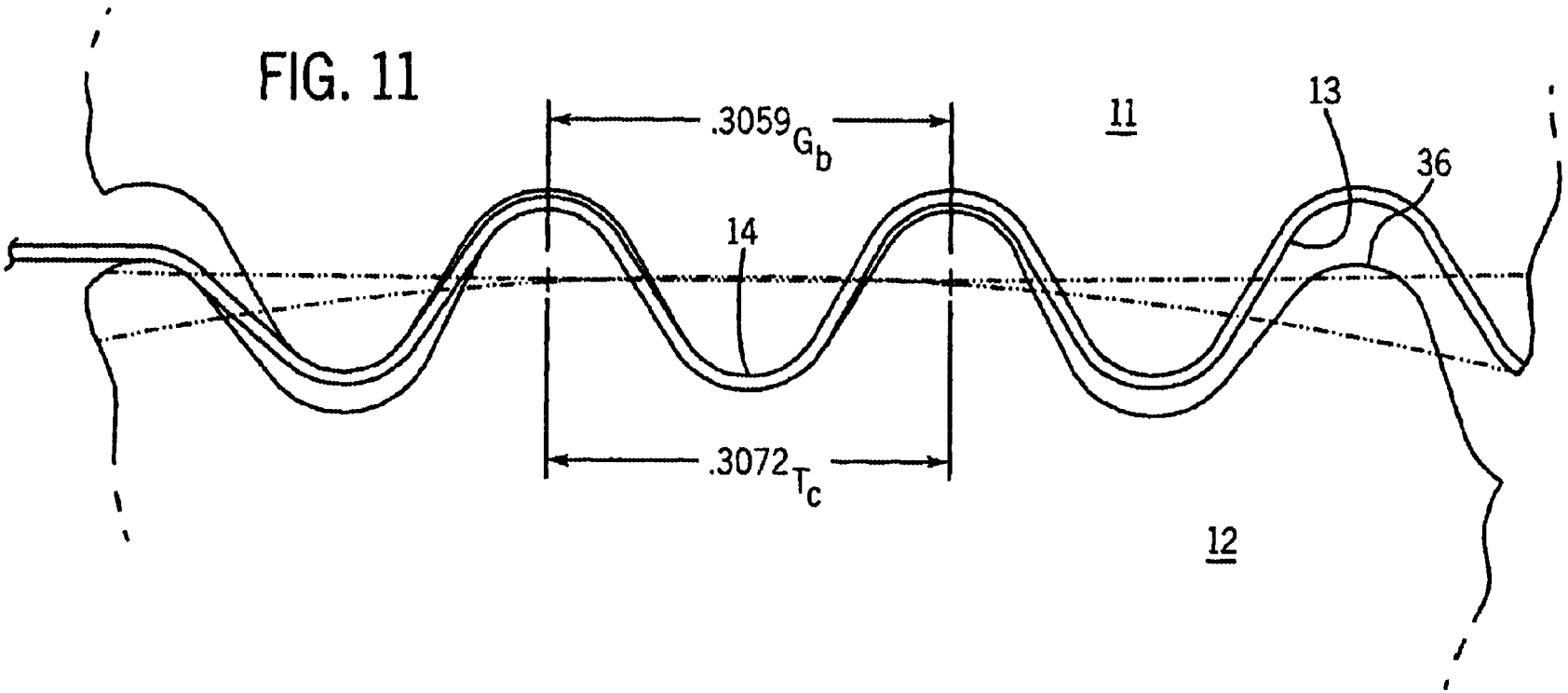

FIG. 10 is a view similar to FIG. 9 showing a modified flute profile designed to lessen considerably the difference between the chordal distances described with respect to FIG. 9. The flute profile of the large diameter bonding roll 11 is unchanged from FIG. 10. Thus, the chordal distance $T_b$ is identical in FIGS. 9 and 10. Similarly, the chordal distance $G_b$ between the centers of the circular gullets 35 of the bonding roll 11 remains the same in prior art FIG. 9 and the modified arrangement of FIG. 11. Adjustment of the flute profile in the small diameter corrugating roll 12 utilized an averaging calculation intended to provide substantial equality between the fixed chordal tip distance $T_b$ in the bonding roll and the chordal gullet distance $G_c$ in the modified corrugating roll 12 (FIG. 10) and between the fixed chordal distance $G_b$ between the flute gullets 35 of the bonding roll and the chordal distance $T_c$ between the flute tips 36 of the corrugating roll 12 (FIG. 11).

First, using the bonding roll tip chordal dimension $T_b$, an outside tip diameter was calculated for a small diameter lower corrugating roll for a given number of teeth, selected iteratively to provide a fit. Similarly, using the bonding roll chordal gullet distance $G_b$, another tip diameter was calculated for a small diameter corrugating roll 12 in the same way. The two outside tip diameters were averaged and the final chordal dimensions $G_c$ and $T_c$ for the small diameter corrugating roll were calculated. As shown in FIGS. 10 and 11, the new chordal dimensions $G_c$ and $T_c$ are much closer to the corresponding dimensions of the large diameter bonding roll than in the prior art flute profiles. Specifically, differences in the respective chordal dimensions are both only 0.0013 in. (0.03 mm), as compared to the prior art discrepancy of 0.0082 in. (0.2 mm) described above and shown in FIG. 9.

The result of the foregoing flute profile adjustment is elimination of the rotational tooth interference, a reduction in tooth wear, and a more consistent quality in the fluted medium web 13. The matching of flute tip profiles produces uniform flute-to-flute contact, not only tip-to-gullet, but also along the flanks of the interengaging flutes. Such matching is critically important where there is a large difference in the diameters of the bonding roll 11 and corrugating roll 12.

Figure 3:
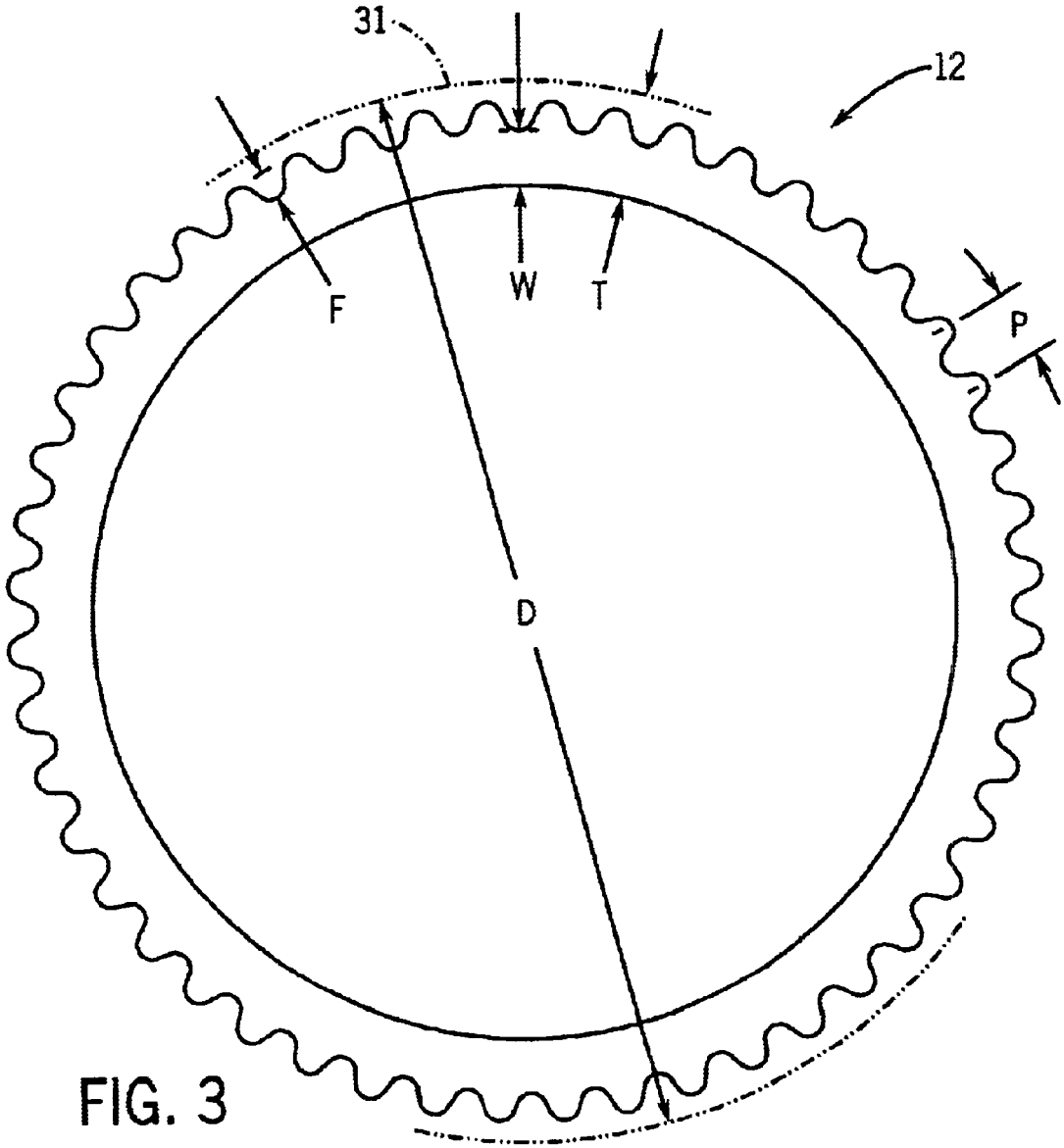
FIG. 3 is an enlarged axial end view of the roll shell of the small diameter corrugating roll of the present invention.
Figure 4:
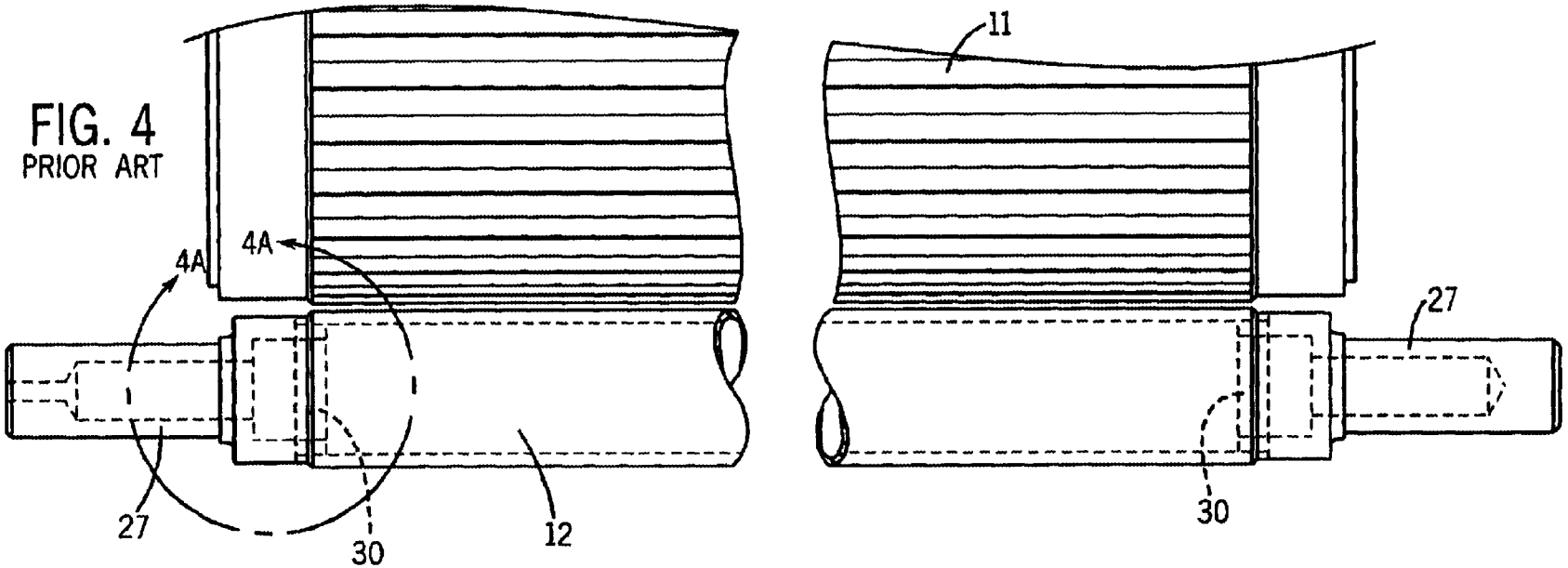
FIG. 4 PRIOR ART
FIGS. 4, 4A and 5, 5A compare prior art and present construction of the stub shafts that support the small diameter corrugating roll.
Figure 4A:
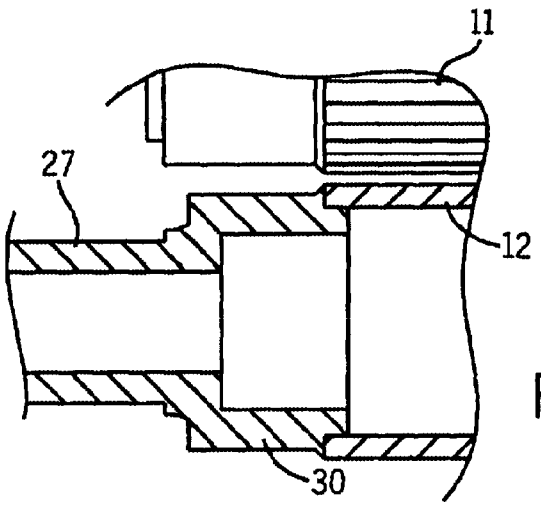

Another problem in the construction and operation of the prior art small diameter corrugating roll concerned the roll shaft ends by which the lower corrugating roll is rotatably supported. In addition to being cradled in the back-up belts 25 of the backing arrangement 23, the small diameter lower corrugating roll 12 is rotatably supported on stub shafts 27 on axial opposite ends which shafts, in turn, are rotatably mounted in bearings 28. Referring to FIG. 3, showing a schematic relationship between the lengths of the fluting patterns in prior art corrugating rolls 11 and 12, it has been conventional practice to provide both the large diameter upper corrugating roll 11 and the small diameter lower corrugating roll 12 with flute patterns having substantially equal axial lengths. Thus, in a conventional prior art single facer, the flute patterns may typically have axial lengths of 104 inches (about 2640 mm). However, in mounting the large diameter hubs 30, forming the inner ends of the stub shafts 27, inside the ends of the tubular steel shell forming the small diameter corrugating roll 12, the axial inner ends of the hubs 30 extended into the axially outer ends of the flute patterns. Because little or no roll shell deflection was capable at the axial outer ends of the flutes, there were hard spots on both axial ends of the nip between rolls 11 and 12, the result of which was significant and excessive vibration.

FIGS. 4, 4A, 5 and 5A illustrate the improvement in single facer running characteristics provided by an extended length small diameter corrugating roll 12 in which the hard spots at the stub shaft ends have been eliminated. In prior art FIGS. 4 and 4A, the axial flute length of the flexible lower roll 12 corresponds in length to the flute pattern in the large bonding roll 11. However, the overall length of the roll shell is such that the hubs 30 on the axial inner ends of the stub shafts 27 extend about 0.5 inch (about 13 mm) into the ends of the flute pattern. In the corrugating nip 14, therefore, the axial outer ends of the flute pattern in the large diameter bonding roll 11 bear directly on the ends of the flutes in the lower roll 12 supported directly by the hubs 30 thereby permitting little or no radial deflection in the lower corrugating roll 12 at the hubs.

Figure 5:
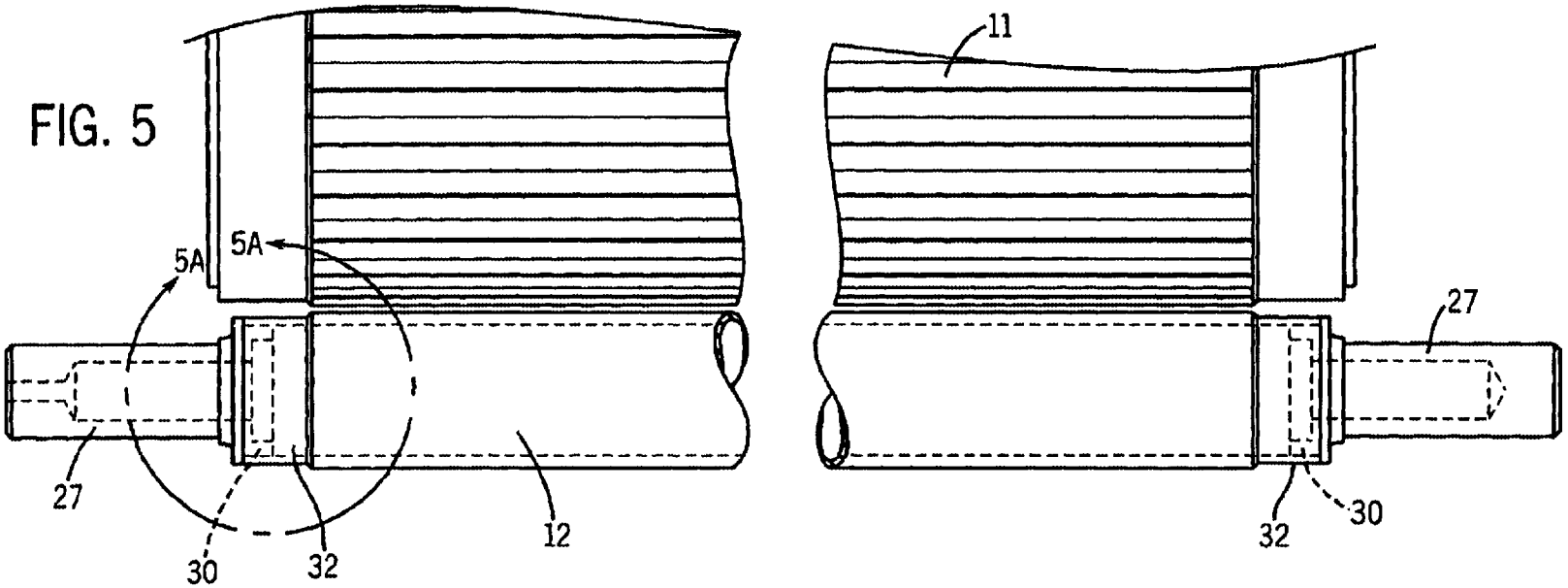
Figure 5A:
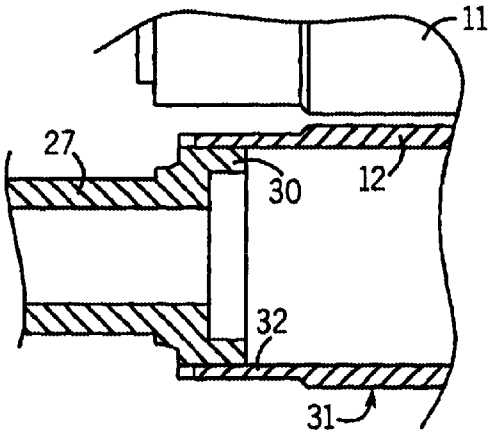

By comparison and referring to FIGS. 5 and 5A showing a modified roll of the present invention, the tubular stock 31 from which the lower corrugating roll 12 is formed is provided with an extended axial length, in this case about 3.5 inches (about 90 mm) greater than the prior art. In the resulting final construction, the hubs 30 are moved farther apart, as compared to the prior art construction, such that the axial inner ends of the hubs are spaced a significant distance outside the flute patterns on the interengaging rolls 11 and 12. The flute pattern in the roll 12 of FIG. 5 is the same axial length (e.g. 104 inches) as in the prior art roll, but the extended length sleeve ends 32 permit the hubs 30 to be spaced about 1.25 inches (about 32 mm) from the ends of the flutes. This permits the flute pattern along the entire axial length of the lower corrugating roll 12 to flex more uniformly to absorb the displacement resulting from chordal action and when loaded against the bonding roll 11 by the backing arrangement 23. Although in an ideal arrangement, the lower corrugating roll might be made from an even longer piece of tubular stock 31, thereby placing the stub shaft hubs 30 even further apart, the present arrangement presents a compromise whereby overall performance is enhanced and major reconstruction of the single facer supporting frame is avoided. As may be seen in FIG. 5, the extended sleeve ends 32 in which the stub shaft hubs 30 are mounted, are smooth cylindrical sections from which the flutes have been removed in a final turning operation. These extended sleeve ends 32 are inherently more flexible than the inner portions of the roll carrying the flutes and this also enhances the roll end deflection as part of the compromise location of the hubs 30 somewhat more closely spaced than in an ideal situation. It is believed that, in an ideal arrangement, the stubs shaft hubs 30 should be spaced from the flutes by a distance of at least one-half the roll diameter.

Figure 6:
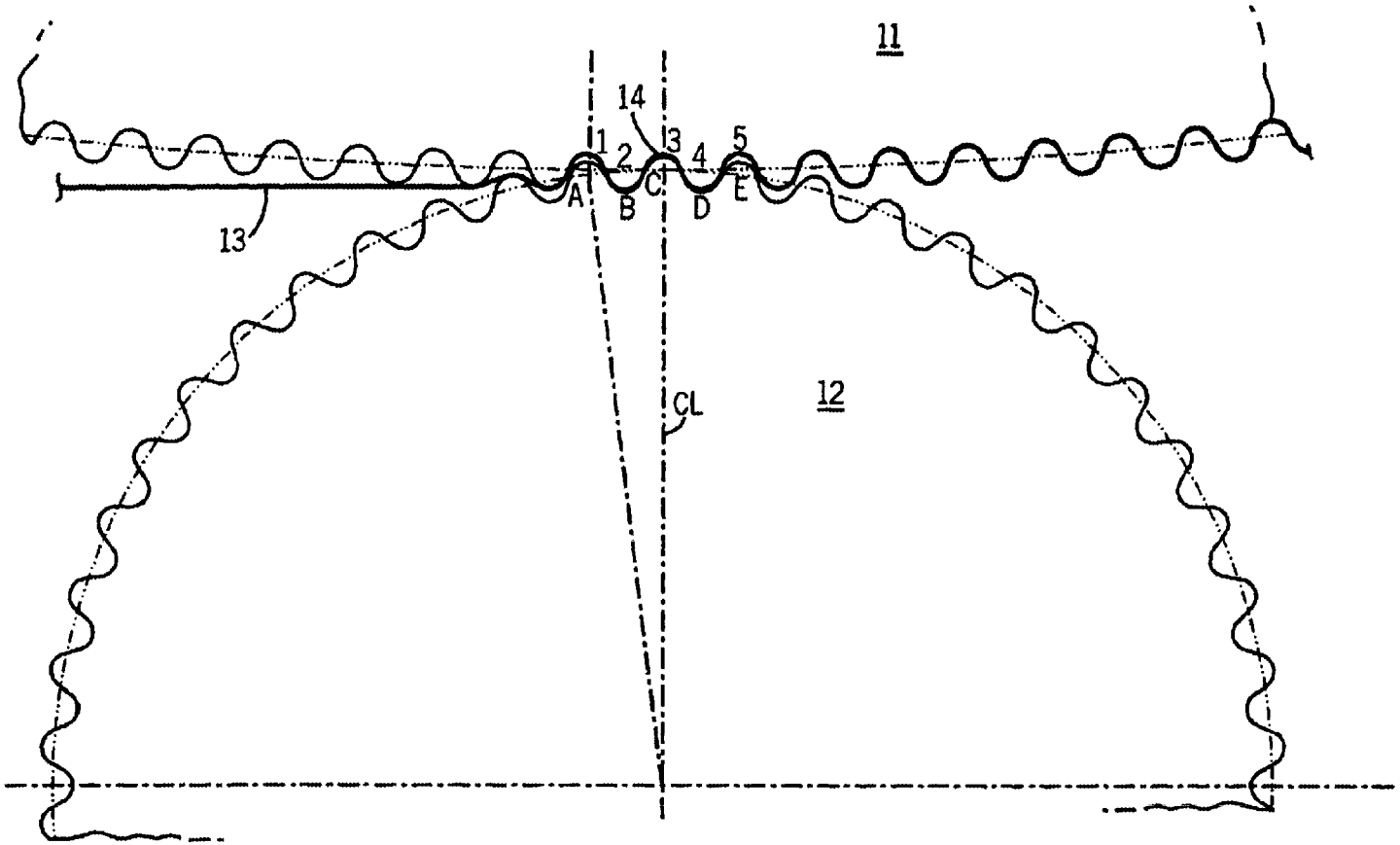
FIGS. 6–8 are large schematic side views of the corrugating nip showing flute progression and small roll displacement at the nip.
Figure 7:
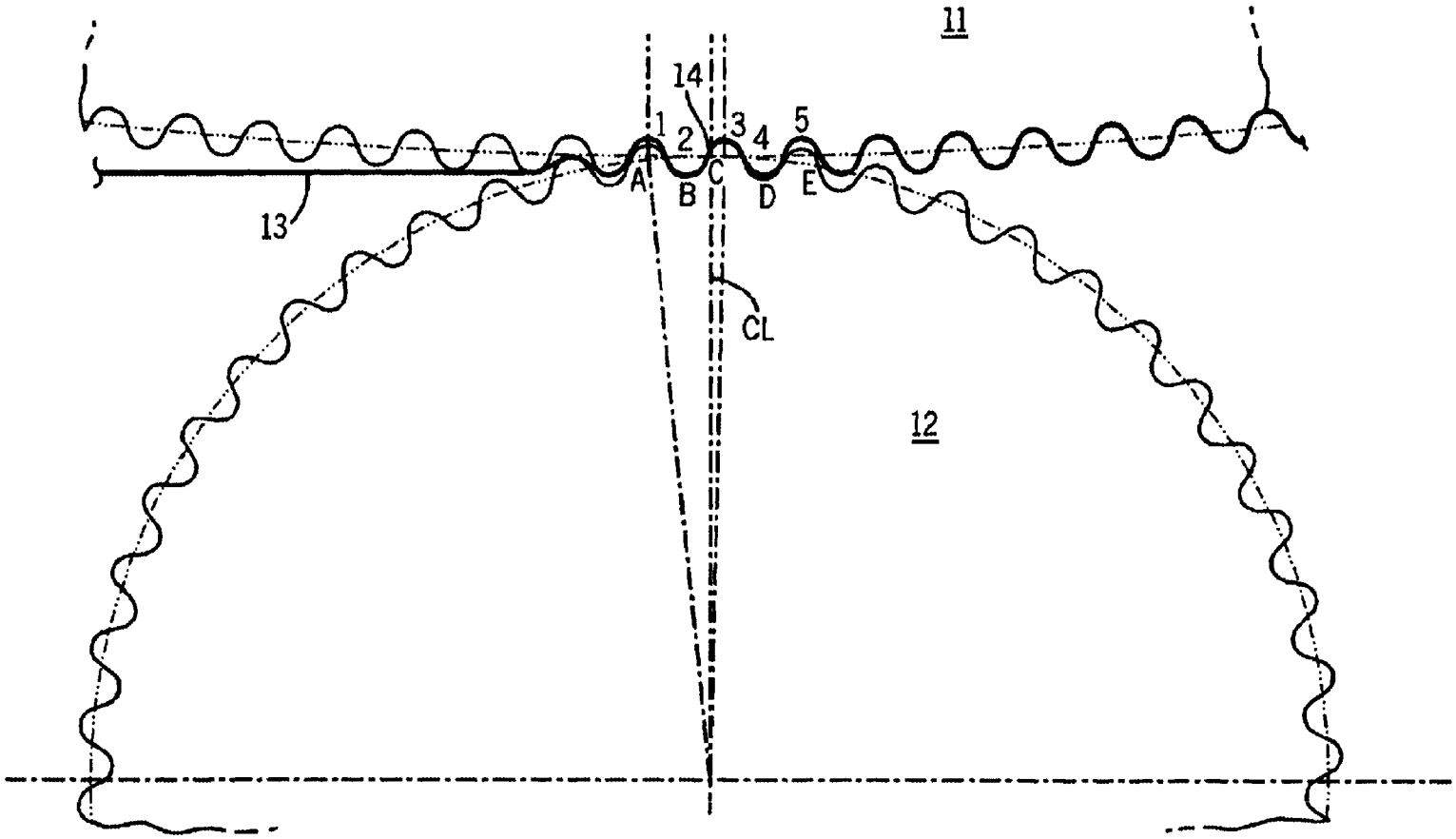
Figure 8:
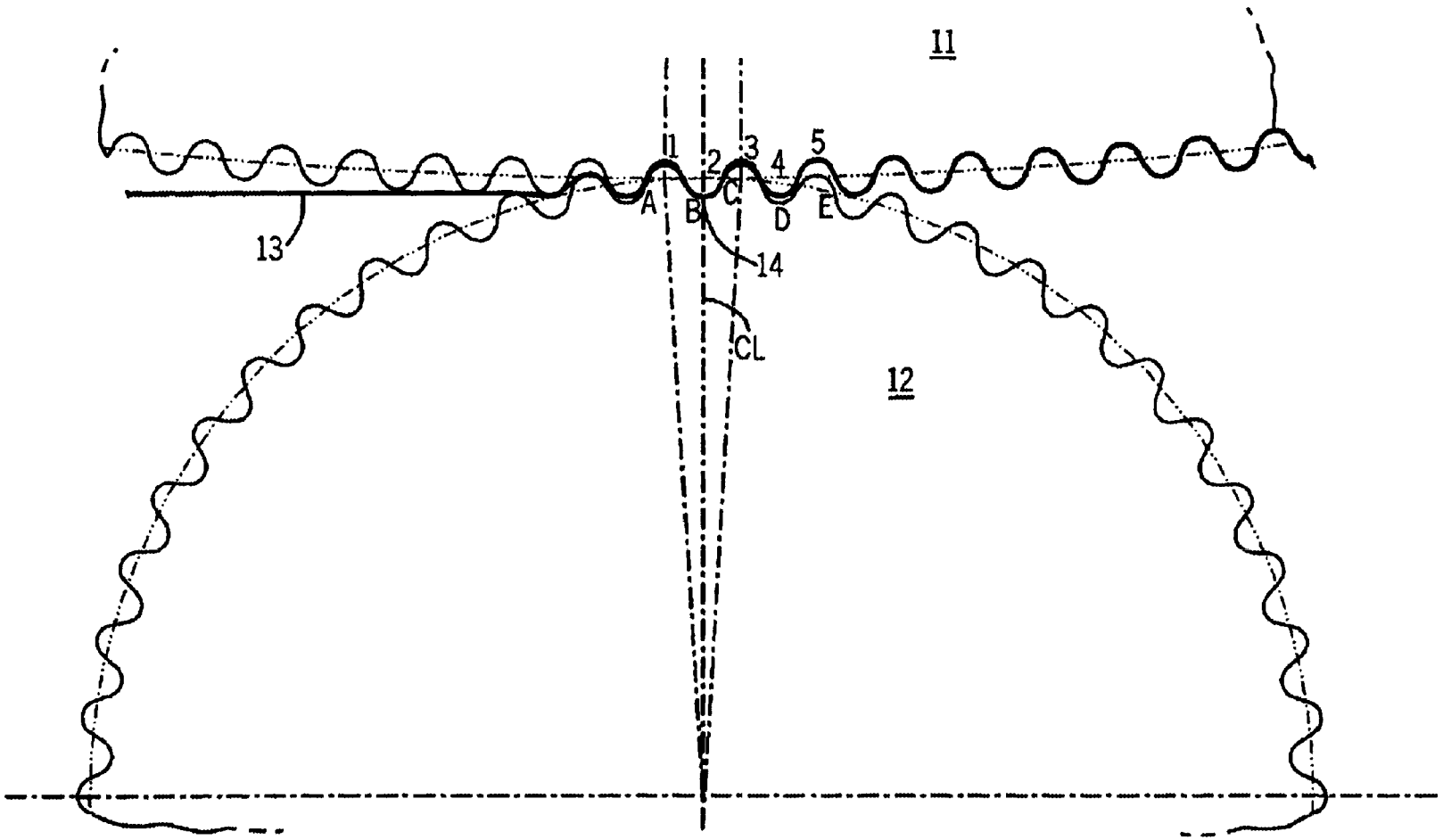

FIGS. 6–8 show, in an enlarged schematic representation, flute-to-flute contact between the large diameter bonding roll 11 and a small diameter flexible corrugating roll 12 as the flutes travel through the corrugating nip 14. The three drawing figures show progressive movement through the nip of one-half flute pitch. In FIG. 6, the flute tip C of the small diameter corrugating roll 12 is at the top dead center position and in full engagement with the gullet 3 in the large diameter bonding roll 11. At this point, the centers of the two rolls 11 and 12 are at a maximum distance apart. FIG. 7 shows continued rotational movement through the nip of one-quarter pitch where engaging contact occurs at the midpoints of the flanks of small corrugating roll flute C and the engaging flute 2 of the upper bonding roll 11. The flank-to-flank contact is on the common centerline CL of both rolls. This is the point of minimum displacement between the rolls as measured on the centerline and, in accordance with the preferred embodiment of the present invention, the displacement is 0.0014 in., representing a substantial reduction in the amplitude of displacement as compared to the prior art. Continuing rotation through another one-quarter pitch is shown in FIG. 8 where the flute tip 2 of the large diameter bonding roll 11 is in full engagement with the gullet B of the small diameter corrugating roll 12. At this point, displacement between the centers of the two rolls as measured on the centerline CL is again at a maximum and equal to the maximum displacement shown in FIG. 6. The displacement of the centers of the two rolls, described above, assumes that both rolls 11 and 12 are of a solid construction. In accordance with the present invention, however, the flexible small diameter roll absorbs the displacement and its centerline position remains fixed.

Even though the amplitude of deflection necessary to absorb the displacement in prior art flexible small diameter corrugating rolls may not have exceeded 0.005 inch (0.13 mm), the effect was still enough to cause premature fatigue cracks in rolls having a minimum wall thickness (after fluting) of 0.21 inch (about 5 mm). By reducing the amplitude of radial deflection of the small diameter corrugating roll in the nip, not only has fatigue cracking been reduced or eliminated, but it has been found possible to reduce the minimum wall thickness in the finished fluted rolls even further. One additional beneficial result of the ability to reduce the minimum wall section is that the overall mass of the roll is also reduced, thereby increasing the natural frequency of the roll. This permits the roll to be operated at substantially higher single facer speed without reaching resonant frequency. It is believed that a minimum wall thickness as small as about 0.15 inch (about 4 mm) may be utilized in a small diameter roll with a nominal OD of about 5.1 inch (about 130 mm).

Referring to FIG. 3 and to demonstrate a range of conventional flute sizes that may be effectively used in thin wall small diameter corrugating rolls, three basic flute patterns have been examined as formed in tubular stock to form a small diameter corrugating roll 12. In one embodiment, the tubular stock 31 comprises a seamless steel tube having an outside diameter (OD), designated as D, of 5.25 inches (133 mm) and an initial wall thickness T of 0.35 inch (about 9 mm). The tubular stock 31 may be made, for example, from 1026 steel (ASTM A5 13 Type 5) with a Rockwell B hardness of 85. However, other steel stock materials, either in tubular form or as machineD from solid stock, could also be used. In accompanying Table I, the dimensions of three commonly used flute patterns are listed, along with the remaining minimum wall thickness W when these flute patterns are formed in the tubular stock 31 of the type described above. Each of the conventional -flute, C-flute, B-flute and E-flute are formed with a standard gullet (flute depth F). In Table I, the C-flute pattern is the largest of the three flute patterns, having the largest pitch P and flute depth F, and resulting in the smallest minimum wall thickness W when the flute pattern is cut in the common tubular stock 31. With a C-flute pattern, which is one of the most commonly used, the remaining minimum wall thickness W, after the flutes are cut into the tubular stock, is about 0.158 inch (4.0 mm). On the other hand, utilizing the much smaller flute pattern of E-flute, the minimum wall thickness shown in Table I of 0.229 inch (about 5.8 mm) will provide the necessary cushioning deflection in the small diameter corrugating roll shell to minimize vibration and noise.

It is believed that a minimum wall thickness up to about 0.32 inch (about 8.1 mm) could be utilized with a nominal 5 inch (125 mm) roll and still provide similar beneficial running characteristics. For example, utilizing steel tube stock of the same initial 5.25 inch (133 mm) diameter, but with a heavier wall thickness of 0.48 inch (about 12 mm), in which are cut C-flute and B-flute patterns, the resulting minimum wall thickness is correspondingly increased as shown in the lower portion of Table I under the heading "Heavy Wall". These rolls also exhibit some of the same beneficial running characteristics as the "Thin Wall" rolls listed at the top of Table I. However, because of the somewhat heavier minimum wall thickness, the heavy wall rolls will not deflect as much in response to chordal action in the nip as the corresponding thin wall roll and, as a result, vibrations will tend to be greater in the heavy wall versions of the C-flute and B-flute rolls.

The examples shown in Table I all represent rolls having nominal 5.1 inch (about 130 mm) diameter ODs in the finished condition. However, rolls utilizing the thin wall flexible roll technology of the present invention may be made with significantly larger diameters but still realize the benefits described above. As the small corrugating roll diameter increases, final minimum wall thickness may also be increased while still retaining the flexible characteristic permitting deflections resulting from chordal action to be dissipated. For example, in a larger diameter roll having a finished OD of about 8.32 inches (211 mm), the minimum wall thicknesses for C-, B-, and E-flute patterns, respectively would be 0.390 inch, 0.440 inch, and 0.490 inch (9.9, 11.2 and 12.4 mm). Relating the final OD dimensions to the minimum wall thicknesses for all of the examples described herein, the benefits of the present invention are applicable to rolls having a ratio of finished OD to minimum wall thickness in the range of about 15:1 to 33:1.

TABLE I

| | Flute pitch (P) in. (mm) | Flute depth (F) in. (mm) | Min. wall thickness (W) in. (mm) |
|---|---|---|---|
| Thin Wall | | | |
| C-flute | .3142 (8.0) | .142 (3.6) | .158 (4.0) |
| B-flute | .2580 (6.6) | .097 (2.5) | .199 (5.1) |
| E-flute | .1310 (3.3) | .045 (1.1) | .229 (5.8) |
| Heavy Wall | | | |
| C-flute | .3142 (8.0) | .142 (3.6) | .283 (7.2) |
| B-flute | .2580 (6.6) | .097 (2.5) | .324 (8.2) |

Although the features of the subject invention are particularly applicable and suitable for use in a single facer in which there is a large ratio in the diameter of the large bonding roll 11 to the small corrugating roll 12 (8:1 in the example described), the teachings are applicable for smaller diameter ratios even though the displacement between roll centers decreases as the diameter ratio decreases. It is believed that the beneficial effects of the subject invention may be readily applied to single facer roll pairs with diameter ratios as small as about 2.2:1. As the difference in diameters of the two single facer rolls decreases at ratios less than 2.2:1, the displacement between the centers of the rolls due to chordal action at the nip approaches about 0.0005 in. (0.013 mm), a point where the improvements provided by this invention decrease in significance.

We claim:

1. A single facer having a large diameter fluted bonding roll with a flute pattern of a given axial length and an interengaging small diameter fluted corrugating roll having a flute pattern corresponding to the flute pattern on the bonding roll and supported for rotatable interengagement with the bonding roll by an axially extending backing arrangement to form a corrugating nip, the improvement comprising:

said small diameter corrugating roll being formed from a cylindrical steel shell, said roll shell being deflectable in operation at the corrugating nip and having a ratio of roll OD to minimum wall thickness after formation of the flutes, said wall thickness measured from the flute gullets to the shell ID, in the range of about 15:1 to about 33:1.

2. The apparatus as set forth in claim 1 including:

a pair of cylindrical hubs having axial inner ends positioned within the opposite ends of the roll shell to support the roll for rotation; and, said roll shell having an axial length sufficient to position the axial inner ends of the hubs outside the bonding roll flute pattern.

3. The apparatus as set forth in claim 1 wherein said backing arrangement comprises a plurality of axially spaced back-up belts.

4. The apparatus as set forth in claim 1 wherein each of said back-up belts is supported on a pair of rollers and includes an actuator for applying a selected support load to the small diameter corrugating roll.

5. The apparatus as set forth in claim 1 wherein the flute patterns in said bonding roll and said small diameter corrugating roll are of the same flute depth.

6. In a single facer having a large diameter fluted bonding roll with a flute pattern of a given axial length and an interengaging small diameter fluted corrugating roll, said small diameter corrugating roll having a thin deflectable outer shell having a flute pattern corresponding generally to the bonding roll flute pattern and supported for interengagement with the large diameter roll to form a corrugating nip by an axially extending backing arrangement, and a pair of rigid stub shafts defining hubs with axial inner ends positioned within the opposite ends of the roll shell to rotatably support said small diameter roll, the improvement comprising:

an extended length roll shell having an axial length sufficient to position the axial inner ends of the hubs outside the bonding roll flute pattern to permit deflection of the roll shell at the nip along the full axial length of the flute pattern.

7. The apparatus as set forth in claim 6 comprising flute patterns in said bonding roll and said small diameter roll of substantially the same pitch and flute depth to assure complete flute-to-flute contact in the corrugating nip.

8. A single facer having a large diameter fluted bonding roll with a flute pattern of a given axial length and an interengaging small diameter fluted corrugating roll having a flute pattern corresponding to the flute pattern on the bonding roll and supported for rotatable interengagement with the bonding roll by a series of axially spaced back-up belts to form a corrugating nip, the improvement comprising:

said small diameter corrugating roll being formed from a cylindrical steel shell deflectable in operation at the corrugating nip and having a ratio of roll OD to minimum wall thickness after formation of the flutes, as measured from the flute gullets to the shell ID, in the range of about 15:1 to about 33:1;

a pair of cylindrical hubs having axial inner ends positioned within the opposite ends of the roll shell to support the roll for rotation; and, said roll shell having an axial length sufficient to position the axial inner ends of the hubs outside the bonding roll flute pattern.

9. The apparatus as set forth in claim 8 wherein the flute patterns in each bonding roll and said small diameter corrugating roll are of the same flute depth.

10. A single facer having a large diameter fluted bonding roll with a flute pattern defined by circular flute tips of a given first radius between circular flute gullets of a given second radius, the centers of adjacent first radii spaced by a given first chordal distance and the centers of adjacent second radii spaced by a given second chordal distance, the improvement comprising a small diameter fluted corrugating roll supported for rotatable engagement with the bonding roll by a backing arrangement to prevent axial bending of the corrugating roll, said corrugating roll having a flute pattern defined by circular flute tips having a tip radius and circular flute gullets having a gullet radius adapted to respectively engage the flute gullets and flute tips of the bonding roll, the chordal distance between the centers of adjacent tip radii being substantially equal to said second chordal distance and the chordal distance between the centers of adjacent gullet radii being substantially equal to said first chordal distance.

11. The apparatus as set forth in claim 10 wherein the ratio of the diameter of the large bonding roll to the diameter of the small corrugating roll is equal to or greater than about 2.2:1.

* * * * *